US005403206A

United States Patent [19]

McNamara et al.

[11] Patent Number: 5,403,206

[45] Date of Patent: Apr. 4, 1995

[54] SHIELDED ELECTRICAL CONNECTOR

[75] Inventors: David M. McNamara, Lyndeborough; Daniel B. Provencher, Weare, both of N.H.; Philip T. Stokoe, Attleboro, Mass.; William E. Howard, New Boston, N.H.; Mark W. Gailus, Somerville, Mass.

[73] Assignee: Teradyne, Inc., Boston, Mass.

[21] Appl. No.: 43,195

[22] Filed: Apr. 5, 1993

[51] Int. Cl.[6] ..... H01R 13/658

[52] U.S. Cl. ..... 439/608; 439/108; 439/607

[58] Field of Search ..... 439/101, 108, 607, 608, 439/571, 573

[56] References Cited

U.S. PATENT DOCUMENTS

| | | | |
|---|---|---|---|
| 3,957,337 | 5/1976 | Damiano | 439/682 |
| 4,806,109 | 2/1989 | Manabe et al. | 439/108 |
| 4,846,727 | 7/1989 | Glover et al. | 439/608 |
| 4,898,546 | 2/1990 | Elco et al. | 439/608 |
| 4,914,062 | 4/1990 | Voltz | 439/608 |
| 4,975,084 | 12/1990 | Fedder et al. | 439/608 |
| 5,055,069 | 10/1991 | Townsend et al. | 439/608 |
| 5,133,679 | 7/1992 | Fusselman et al. | 439/608 |
| 5,135,405 | 8/1992 | Fusselman et al. | 439/108 |
| 5,310,354 | 5/1994 | Oswald, Jr. | 439/608 |

FOREIGN PATENT DOCUMENTS

| | | |
|---|---|---|
| 0422785 | 4/1991 | European Pat. Off. . |
| 0520283 | 12/1992 | European Pat. Off. . |
| 0561202 | 9/1993 | European Pat. Off. . |

*Primary Examiner*—Gary F. Paumen

[57] ABSTRACT

Electrical connectors are provided with shield units each having a plurality of shields joined by a bridge. Preferably the shield units are mounted in a base stiffened by means apertured to carry mounting ear means.

22 Claims, 6 Drawing Sheets

SHIELDED ELECTRICAL CONNECTOR

FIELD OF THE INVENTION

This invention relates to board electrical connectors, and more particularly to such connectors in which signal pins are shielded.

BACKGROUND OF THE INVENTION

Shielding pins in a board electrical connector is known to be desirable: for example, Glover et al. U.S. Pat. No. 4,846,727 and Fedder et al. U.S. Pat. No. 4,975,084.

SUMMARY OF THE INVENTION

We have discovered that an improved board electrical connector may be provided by mounting, in a base in which are mounted signal pins a shield unit comprising a plurality of shields and means for interconnecting at least one board and another device outside the connector.

In preferred embodiments, there is provided a molded plastic insulating base with, extending in a grid extending longitudinally of said length and across a shorter transverse width a grid of a multiplicity of small holes with signal pin receptacles mounted therein and a multiplicity of H-shaped holes with shield units mounted therein, the shield units including two conductive shields, each carrying a pin receptacle centrally transversely thereof, and extending over the signal pins therebetween, the two shields being electrically connected through an integral conductive bridge integral also with a shield pin, the shield pins being adapted to engage a daughter board in a pattern shared by the signal pins, and the shield unit receptacles being adapted to engage a backplane connector element pin in a pattern shared by the signal pins, the shields being apertured and the base being secured to the daughter board through a stiffener extending along one side of the base and secured through tabs thereon in base receptors and cooperating through keyhole apertures with ears slidably mounted therein and fastened to the daughter board.

PREFERRED EMBODIMENTS

There follows a description of preferred embodiments, in structure and operation.

Drawings

FIG. 6(*b*) is a bottom elevational view of the element of FIG. 6(*a*).

Structure

Figure 1:
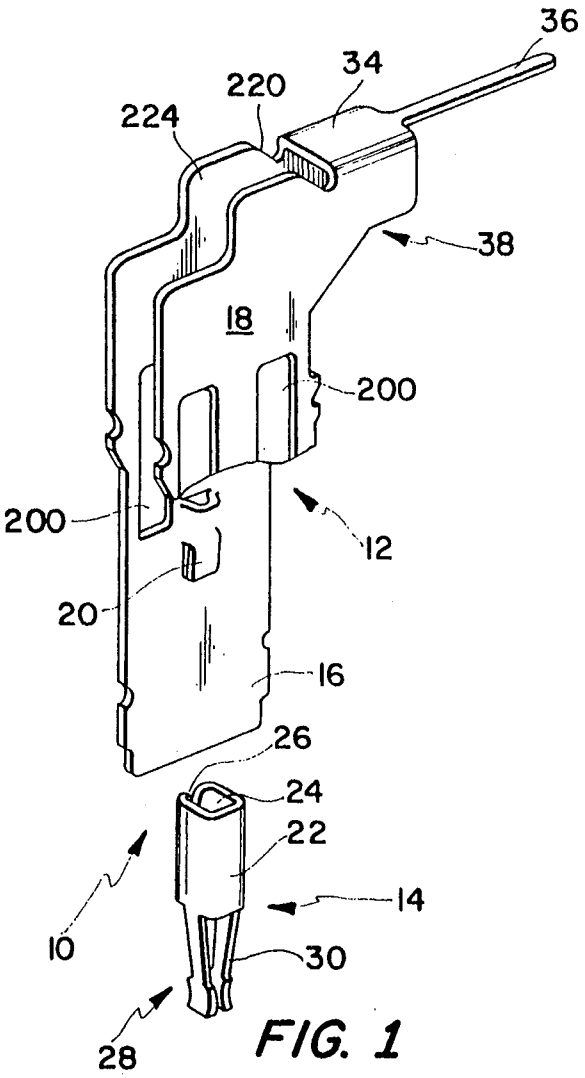
FIG. 1 is an exploded, broken away, isometric view of a shield unit according to the invention.

Referring to FIG. 1, there is shown a shield unit according to the invention, indicated generally at 10. Shield unit 10 includes a shielding portion, indicated generally at 12, and a contact portion, indicated generally at 14.

Shielding portion 12 includes correspondingly externally configured shields 16 and 18 (the latter shown with its lower portion broken away). Formed integrally with shields 16 and 18, by slitting and forming, are receptacle holders 20 (not shown on shield 18 because that shield is broken away), opposingly located to each secure against its shield thereat a contact portion 14 formed from a single sheet of conductive metal to provide an upper held portion 22 (in cross-section a sort of hollow square 24, abutting metal edges thereof being located along a line 26), held on opposing sides of portion 22 by the two receptacle holders 20 of a unit 10, and a lower receptacle indicated generally at 28 and with a pair of cantilevered spring contact arms 30 for being springingly urged apart by a cooperating contact pin, as will be seen. Extending between shields 16, 18 is an integral therewith bridge 34 from which integrally extends ground contact pin 36. Bridge 34 defines with shields 16 and 18 a portion indicated generally at 38 which is upsidedown-U-shaped in-cross-section.

Figure 2:
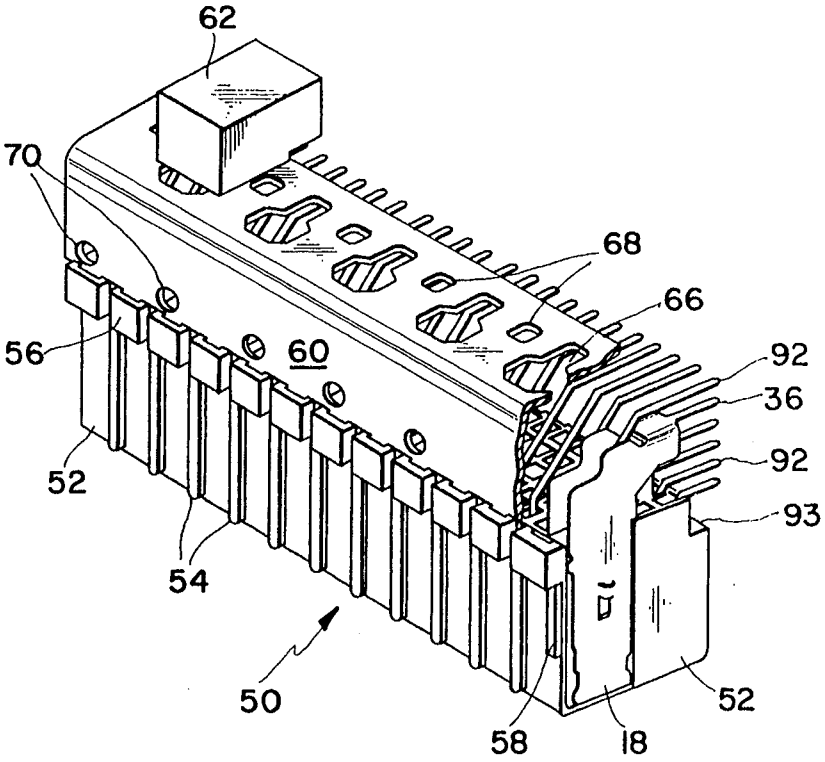
FIG. 2 is an isometric view, partially broken away, of the daughter board connector element of a preferred embodiment of the invention.

In FIG. 2 is indicated generally at 50 a daughter board connector element according to the invention.

This element 50 includes a base 52 of injection molded plastic having molded integrally therein a multiplicity of alinement ribs 54 on each side thereof, and a multiplicity of tab receptors 56 on one side thereof. Also molded therein is shortened rib 58.

Mounted on element 50 are stiffener 60 and mounting block 62.

Figure 4:
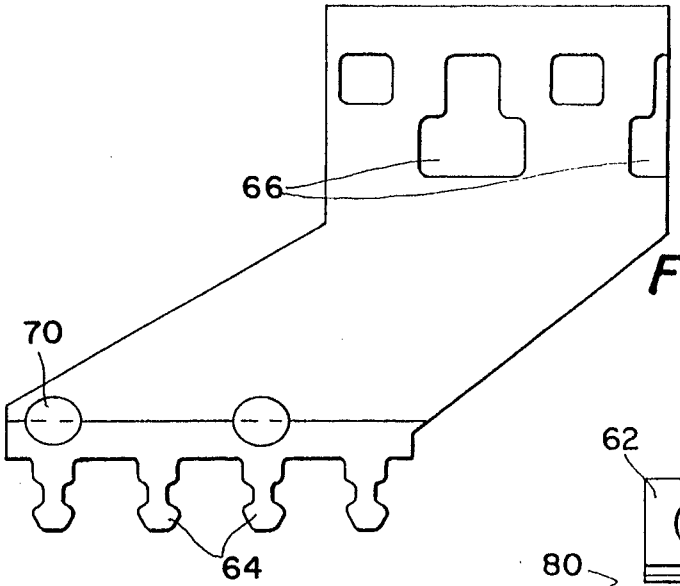
FIG. 4 is a partial plan view of an unbent blank suitable to be formed into an element of the embodiment of FIGS. 2 and 3.

Stiffener 60 is formed of sheet stainless steel and includes a multiplicity of tabs 64 (FIGS. 4 and 5, the former showing the blank strip later formed into the stiffener of FIGS. 2 and 5). Stiffener 60 includes a multiplicity of each of keyhole holes 66, square holes 68, and round holes 70.

Figure 6A:
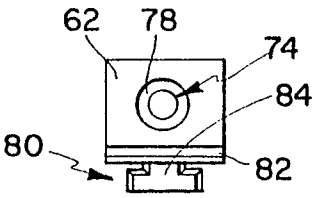
FIG. 6(*a*) is an end elevational view of an element of the subassembly of FIG. 5.
Figure 6B:
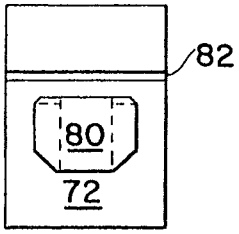
Figure 5:
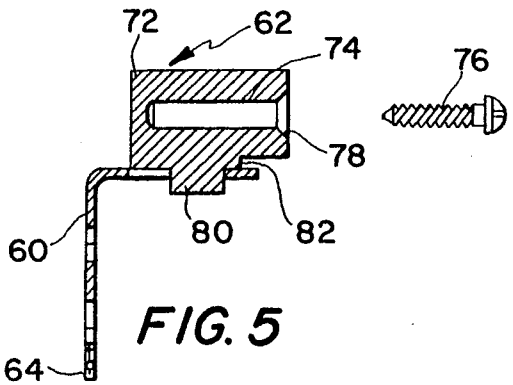
FIG. 5 is an exploded view, partially in section, of a subassembly of the embodiment of FIGS. 2 and 3.

Mounting ear 62 (indicated generally at 62, and shown in more detail, in FIG. 5) includes body 72 in which extends internally threaded portion 74 for engagement with fastener 76 and including countersink 78 and a shank indicated generally at 80 in FIGS. 5, 6(*a*), and 6(*b*). Extending across body 72 is step 82. Shank 80 is T-shaped (FIG. 6(*a*)), with chamfers on its side and top edges of its portion 84 spaced from body 72.

Figure 3:
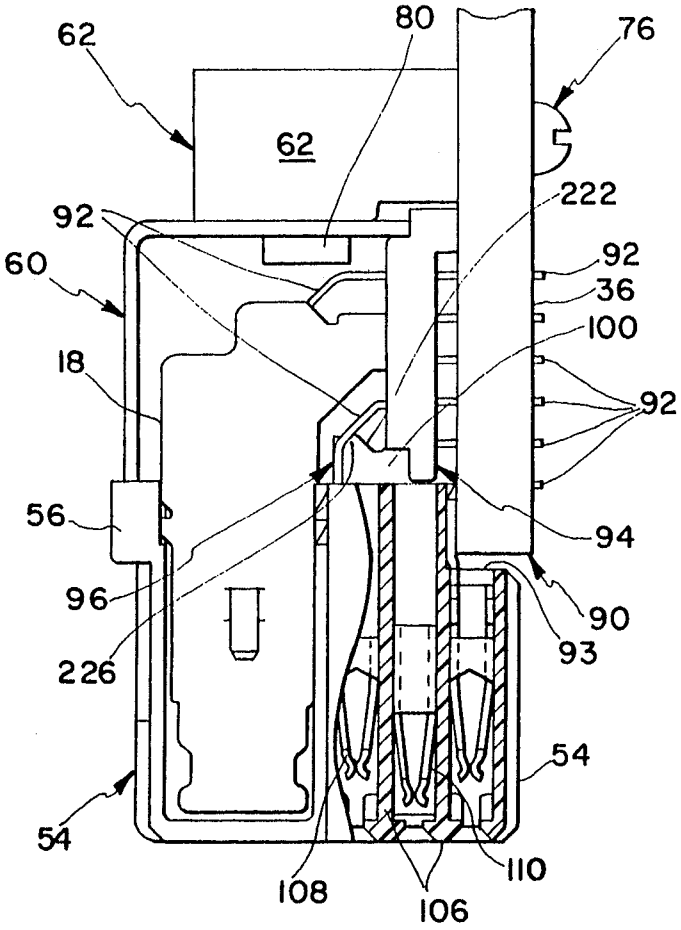
FIG. 3 is an end elevational view, partially broken away, of the embodiment of FIG. 2.

There is shown in FIG. 3 daughter board 90, held against mounting block 62 by fastener 76. Extending through daughter board 90 are ground pins 36 and signal pins 92. Base 52 is provided with longitudinal notch 93 to accommodate daughter board 90. The pins extend also through guide 94.

Figure 8:
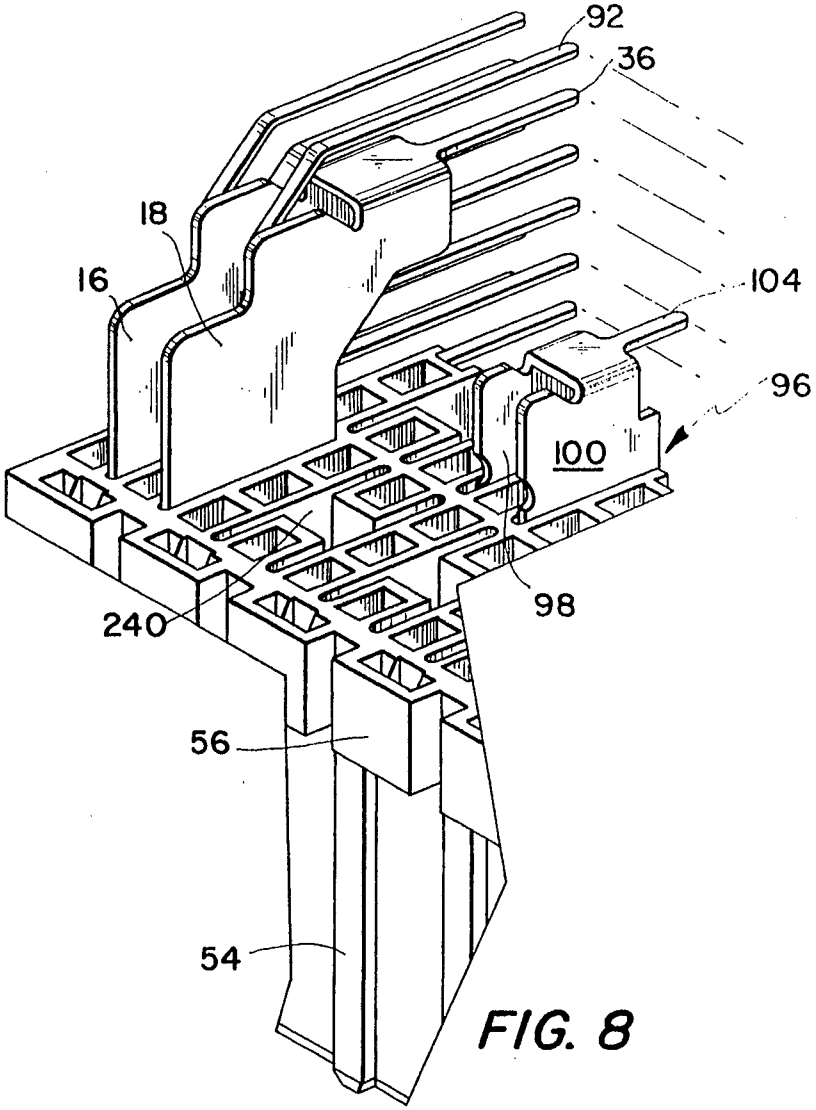
FIG. 8 is an isometric view, broken away, of an end portion of a subassembly of the embodiment of FIGS. 2 and 3.
Figure 7:
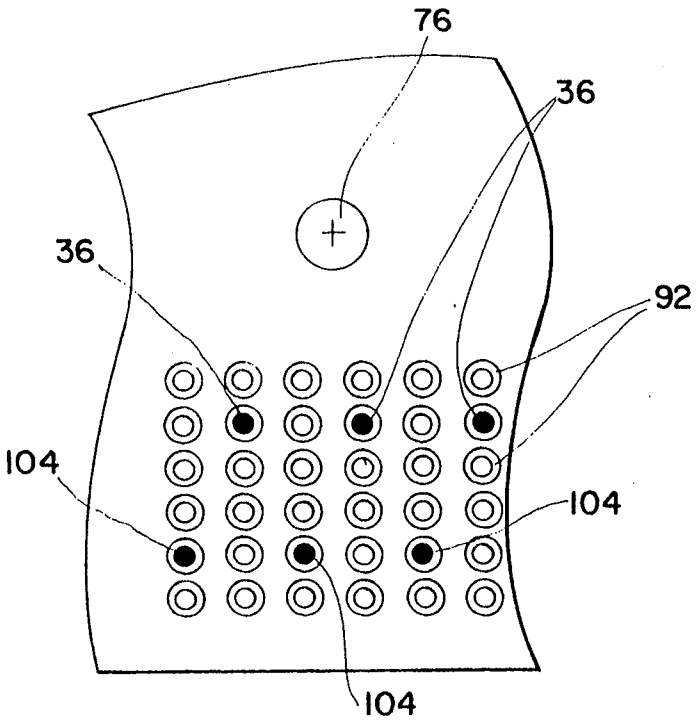
FIG. 7 is a partial, somewhat diagrammatic, side view of a portion of the daughter board element shown in FIG. 3.

A shield unit, of different, shorter configuration than shield unit 10, is shown at 96 (and indicated generally at 96 in FIG. 8). The unit 96 includes a pair of shields 98, 100 each carrying (not shown) a lower receptacle 28 just as does unit 10. Ground pins 104 extending through the daughter board from shield units 96 extend in alternate vertical rows, always in this embodiment in the second horizontal row from the bottom, as diagrammatically shown in FIG. 7, in which are shown unit 96 ground pins 104, unit 10 ground pins 36 (all darkened for diagrammatic ease of understanding), and (undarkened) signal pins 92 (shown in FIG. 3 in a vertical row not including a ground pin 104); as here, ground pins 36 occur also in alternate vertical rows, those not including ground pins 104.

Integral with the rest of base 52 are walls 106 separating various receptacles; shown in FIG. 3 are signal receptacles 108 and ground receptacle 110 (which is mounted on shields 98, 100 of shield units 96 (mounting not shown, but as in FIG. 1)). These walls extend in a grid in both transverse (as shown in FIG. 3) and longitudinal directions (as shown in FIG. 2).

Figure 10:
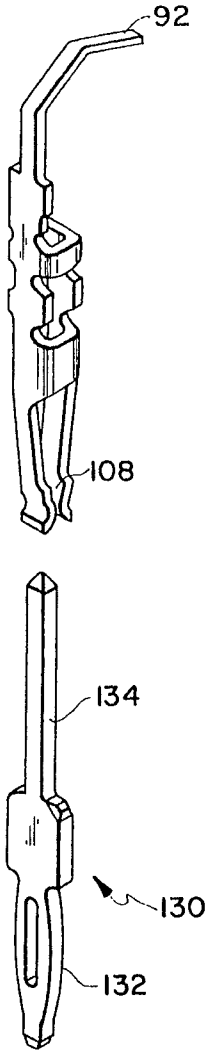
FIG. 10 is an exploded isometric view of a daughter board connector receptor element with integral signal pin and a backplane connector element pin for cooperation therewith in a preferred embodiment of the invention.
Figure 9:
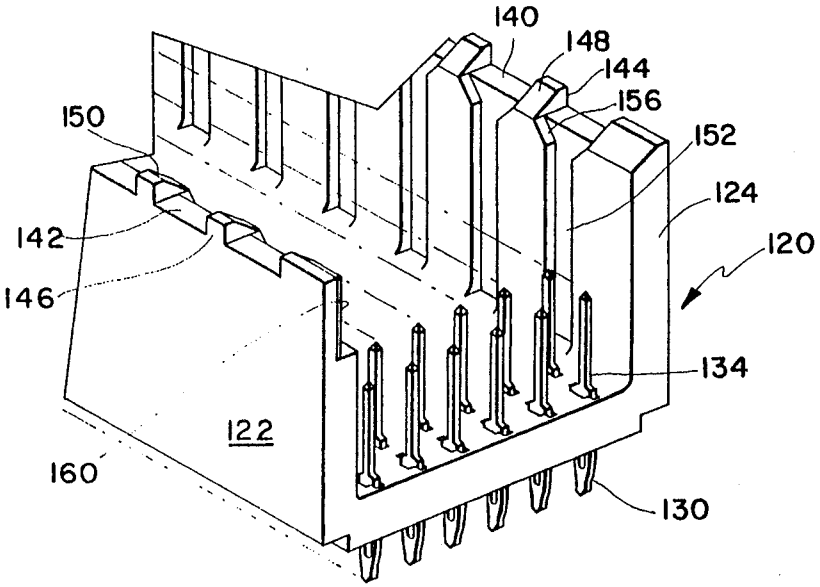
FIG. 9 is an isometric view, broken away, of a backplane connector element useful in a preferred embodiment of the invention.

There is shown in FIG. 9 a backplane connector element 120 of a preferred embodiment. A base portion 126 is integrally injection molded of plastic with side portions 122 and 124. Mounted in holes in bottom 126 are dynamic pins 130 (FIG. 10), which include dynamic end 132 for engaging a backplane (not shown) and contact portion 134 for engaging receptacle 108.

Each side wall 122, 124 includes correspondingly longitudinally positioned and sized notches 140, 142 to receive tab acceptors 56. Between notches 140, 142 extend upwardly therefrom longitudinally shorter protuberances 144, 146 with downwardly, inwardly slanting surfaces 148, 150. Downward from notches 140 extend alinement grooves 152, correspondingly sized and located inside sides 122, 124, to accept alinement ribs 54 and rib 58. Slanted surfaces 156 extend from the bottoms of protuberances 144, 146 to grooves 152. Notch 160 provides clearance for rib 58 (FIG. 2).

Rectangular apertures 200 are provided in shields 16, 18 and (not shown) 98, 100, for capacitance adjustment. Each of the four shields is of 5 mm. transverse dimension at its portion which includes rectangular holes 200. Each of the holes 200 is one millimeter in that width direction and two millimeters in its vertical direction; the wall spacing them is two millimeters in width. Holes 200 are not shown in FIGS. 3 and 8.

Notches 220, 222 permit respectively portions 224, 226 to extend upwardly farther for greater signal pin area shielding (FIGS. 1 and 3).

Shield units 10, 96 are received in H-shaped slots 240 (FIG. 8). One shield of a shield unit fits in each thin leg of the H. The contact portion 14 extending between a pair of shields of a shield unit extends through that portion of the wide cross-bar of the H not occupied by a thin shield portion.

Figure 11:
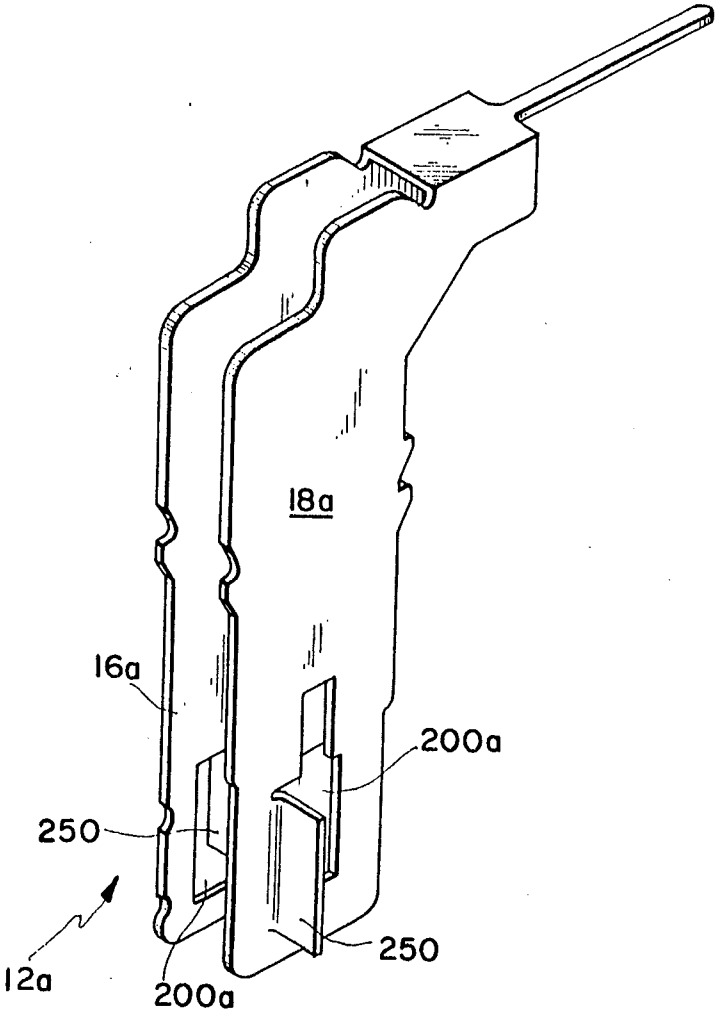
FIG. 11 is an isometric view of a modified embodiment of the shield unit of the invention.

FIG. 11 illustrates a modification of the shield unit 12*a* of the invention in which the metal of shields 16*a*, 18*a* is cut on three sides of apertures 200*a*, the peninsular metal then being folded out perpendicularly to provide tab shields 250 shielding between (FIG. 12) certain pins 92, for portions of their heights corresponding to the vertical extents of tabs 250.

Figure 13:
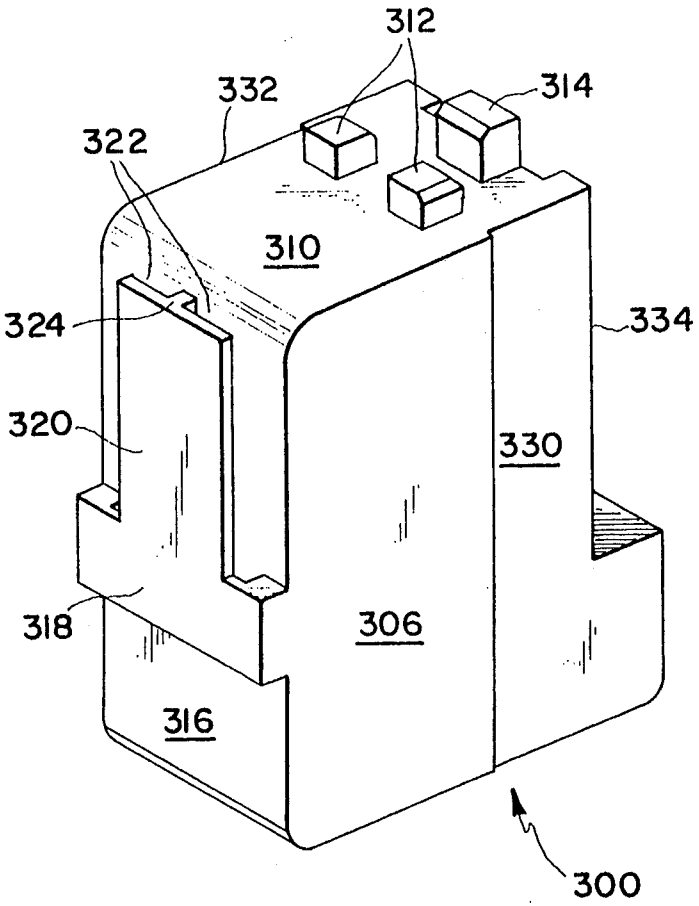
FIG. 13 is an isometric view of a stiffener coupler of the invention.

FIG. 13 illustrates a coupler unitarily injection molded of plastic and useful to mount two stiffeners, not only relative to other portions of their respective modules but to each other as well. Coupler 300 body 306 includes top surface 310 from which protrude two generally cubical protuberances 312 and a higher rectangular protuberance 314. The protuberances 312 are sized and spaced to fit with stiffener square holes 68 and/or the three-sided-square portions of keyholes 66 (FIG. 2). From front surface 316 extends shelf 318, centrally upwardly of which extends receptor 320 defining with body 306 a pair of slots 322 sized to accept respectively the ends of a pair of stiffeners 60. Between slots 322 is ridge 324 which includes a pair of abutment surfaces 326. Shelf 318 includes a pair of tab receptor holes 328.

Notches 330, 332, and 334 are provided for interfitting, as will be seen.

Figure 14:
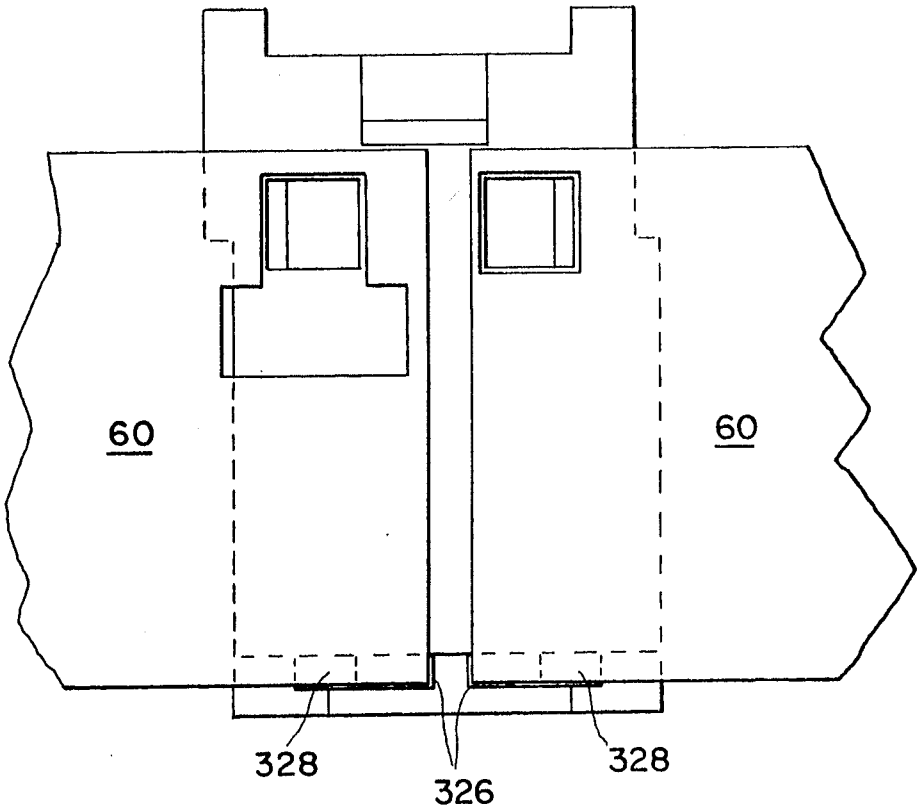
FIG. 14 is a plan view of the coupler of FIG. 13, showing portions of two adjacent stiffeners.

As shown in FIG. 14, stiffener 60*a* and 60*b* have ends disposed in slots 322, their end edges abutting abutment surfaces 326, their bottom surfaces abutting shelf 318, and their side surfaces abutting protuberance 314.

Operation

Stiffener 60 serves as a locator for modules, not all of which embody the invention, being multiplexed. When mounting is with ear 62, flange 80 is inserted through the largest, generally rectangular, portion of keyhole 66 (FIGS. 5 through 6(*b*)), and then moved so that the edges of the smaller portion of hole 66 are in the slot defined between 84 and 62 of the ear. (An alternative, less presently preferred keyhole configuration is shown in FIG. 2.) Square holes 68 permit, if desired cooperatively with the small, generally square, parts of keyholes 66, mounting suitably sized modules, as for power supply, beneath rather than above stiffener 60, to conserve space. Round holes 70 facilitate cleaning during manufacture; thus, after soldering, solutions and air blowing may be used to clean the assembly inside the stiffener.

The stiffener functions with connector elements to facilitate accuracy and ease of positioning properly the latter and other elements, if desired. Stiffener configuration increases usable area and enhances card flatness control.

The shields reduce inductive and capacitive crosstalk, and act as low inductance ground return paths to affect signal path impedance and reduce switching noise. They enhance signal integrity.

Provision of holes 200 allows tuning of capacitance of and inductance between shields (16 and 18) and between adjacent signal pins.

Shields of shield units may be extended downward to shield pins within the backplane.

Providing a shield 18 outboard of base 52 gives shielding between modules (FIGS. 2 and 3). A shield (not shown) is similarly positioned on the opposite longitudinal end and opposite side of the module.

Figure 12:
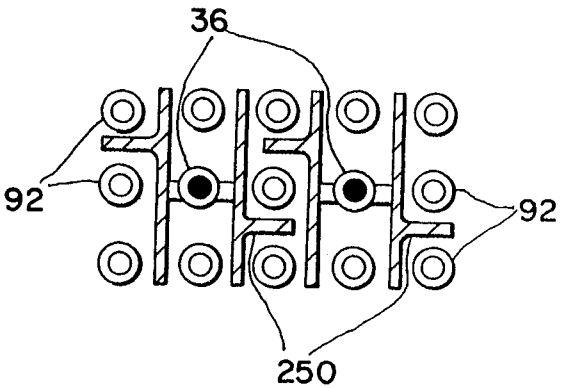
FIG. 12 is a diagrammatic partial sectional view taken on a horizontal slice through the embodiment of FIG. 11, along a plane about halfway up the bent-out shield portions perpendicular to the shield apertures.

Striking out tabs shields, as shown in FIGS. 11 and 12, valuably provides for additional direction shielding.

Using the coupler illustrated in FIGS. 13 and 14 provides simply for module and stiffener alignment and enhances structural integrity.

Other Embodiments

Other embodiments of the invention will occur to those skilled in the art.

Single module embodiments, as shown in the figures and described, may be multiplexed, as along a single stiffener, along which may be mounted not only embodiments of the shielding invention but as well other modules, such as power supply modules and guidance modules to assist in orientation of other modules.

Mounting ears may be of metal, and serve the additional function of ground conduit.

The plastic housing surrounding the daughter board connector element may completely enclose the outermost shields or shield.

Metal struck from shields in making apertures may be bent out from shield main bodies in order to provide further shielding.

The spring contact arms on a shield may be made integral with the main body of the shield-stamped out thereof and formed.

Level of capacitive and inductive shielding, as well as impedance of signal paths, may be varied by changing the number, size, and placement of shield apertures, as well as material and spacing of shields.

A shield unit may be used to transmit power input rather than as a ground.

Identical backplane and daughter board contacts, and connector element contacts for both, may be used to engage both signal pins and ground pins. A consistent footprint or pattern of ground and signal connections, for ease of user understanding and use, is thus made possible.

High signal pin density is possible, and achieves increased signal integrity with fewer reference position connections.

Shield contact receptacles may be formed integrally with their shields. They may be so formed to cooperate with blades, as disclosed in the commonly assigned application of Provencher et al., "Power Connector", Ser. No. 08/040,650 filed Mar. 31, 1993.

We claim:

1. A circuit board connector element comprising:
a base,
a multiplicity of pins, and
a shield unit,
said shield unit including
a first shield,
a second shield, and
bridge means interconnecting said first shield and said second shield,
the shields being conductive and on opposed sides of at least one of said pins, and
in which said bridge is conductive and has integrally extending therefrom a conductive pin,
said base being of insulative material, and including a multiplicity of first apertures therethrough,
at least some of said pins being positioned in at least some of said first apertures, and
at least one second aperture H-shaped in cross-section extends through said base, and a said shield unit extends through at least one said second aperture.

2. The element of claim 1 in which a multiplicity of said pins extend through a multiplicity of said first apertures, and a multiplicity of said shield units extend through a multiplicity of said second apertures.

3. The element of claim 2 in which said first apertures extend along said base alternatingly with said second apertures.

4. A circuit board connector element comprising
a base,
a multiplicity of pins, and
a shield unit,
said shield unit including
a first shield,
a second shield, and
bridge means interconnecting said first shield and said second shield,
the shields being conductive, and including a stiffener and an ear,
said stiffener including an aperture, and
said ear being shaped to fit in and to provide first fastening means with said aperture and carrying second fastening means for cooperation with a board, and
in which said aperture is a keyhole having two areas, one of said areas being a first dimension greater than the largest dimension of the other of said areas.

5. The element of claim 4 in which said ear includes a base and a flange.

6. The element of claim 5 in which said ear includes the base spaced from said flange by a groove therebetween.

7. The element of claim 6 in which said stiffener is of a thickness to slip in said groove and said flange has a third dimension less than said first dimension and greater than said largest dimension.

8. The element of claim 7 in which said fastening means is female internal threads.

9. The element of claim 4 in which said stiffener is bent at 90° relative to a longitudinal line to provide two longitudinally extending portions, said aperture being in a first portion of said portions, and at least one tab extending from the second portion of said portions.

10. The element of claim 9 which includes more than one said aperture.

11. The element of claim 10 in which at least one said aperture is of shape different from at least one other said aperture.

12. The element of claim 11 in which said base includes one receptor opening mating with each said tab of said stiffener.

13. A circuit board connector element comprising
a base,
a multiplicity of pins mounted in said base, and
a stiffener unit,
said stiffener unit comprising a stiffener and an ear, said stiffener including a first aperture, said ear being shaped to fit in said first aperture and carrying fastening means, and
in which said aperture is a keyhole having a first larger area and a second smaller area and said ear includes upper and lower portions too large to enter said second area and a groove therebetween cooperative with said stiffener to permit said ear to move therealong into said second smaller area.

14. A circuit board connector element comprising
a base,
a multiplicity of pins, and
a shield unit,
said shield unit including
a first shield, a second shield, and
bridge means interconnecting said first shield and said second shield,
the shield being conductive, and
in which said shield unit includes a pin receptacle,
said pin receptacle being electrically and mechanically joint with each said shield.

15. The connector element of claim 14 which includes a contact portion of a single sheet of formed metal, said sheet providing a held portion and, protruding therefrom, at least one receptacle cantilever arm.

16. The connector element of claim 15 in which each said shield grips said held portion and two said arms extend from said held portion, said arms facing each other to provide said pin receptacle.

17. A circuit board connector comprising
a base,
a stiffener, and
a plurality of pins,
said base supportedly carrying said pins insulatively therethrough,
said pins extending above and spaced from said base in a first direction angularly related to a second direction of said pins in said base,
said stiffener being carried by said base and including a top portion extending above said pins over the portions thereof extending in said first direction, and
said stiffener including through the thickness of said top portion a plurality of mounting holes,
said holes including holes of two different configurations,
one of said configurations being a keyhole, and
another of said holes being square, said stiffener being spaced above said pins sufficiently for mounting a component in said square hole and between said stiffener and said pins.

18. A circuit board connector comprising
a base,
a stiffener, and
a plurality of pins,
said base supportedly carrying said pins insulatively therethrough,
said pins extending above and spaced from said base in a first direction angularly related to a second direction of said pins in said base,
said stiffener being carried by said base and including a top portion extending above said pins over the portions thereof extending in said first direction, and
said stiffener including through the thickness of said top portion a plurality of mounting holes,
an ear extending through and mounted in at least one of said holes,
said ear including
a board-engaging portion and a stiffener-engaging portion,
said stiffener-engaging portion extending from said board-engaging portion and defining between said board-engaging portion and a flange of said stiffener-engaging portion a groove for accepting the thickness of said stiffener.

19. The connector of claim 18 in which two of said holes are keyholes, said flange and larger part of each said keyhole being sized for acceptance therethrough of said flange by said larger part, and the smaller part of each said keyhole and said groove being sized for acceptance in said groove of said smaller part but not said larger part.

20. A circuit board connector comprising
a base,
a stiffener, and
a plurality of pins,
said base supportedly carrying said pins insulatively therethrough,
said pins extending above and spaced from said base in a first direction angularly related to a second direction of said pins in said base,
said stiffener being carried by said base and including a top portion extending above said pins over the portions thereof extending in said first direction,
said stiffener including through the thickness of said top portion a plurality of mounting holes, and
in which said stiffener is secured along its lower edge portion in said base,
said stiffener along said lower edge portion and said base along an upper portion thereof carrying mating male and female elements.

21. The connector of claim 20 in which said male elements are projections along said lower edge portion and said female elements are slots in said base.

22. A circuit board connector comprising
a base,
a stiffener, and
a plurality of pins,
said base supportedly carrying said pins insulatively therethrough
said pins extending above and spaced from said base in a first direction angularly related to a second direction of said pins in said base,
said stiffener being carried by said base and including a top portion extending above said pins over the portions thereof extending in said first direction, and
said stiffener including through the thickness of said top portion a plurality of mounting holes,
an ear extending through and mounted in at least one of said holes,
said ear including
a board-engaging portion and a stiffener-engaging portion,
said board-engaging portion including fastener receiving means for engaging a fastener from said board,
said fastener receiving means being female threads.

* * * * *